US008778039B2

(12) United States Patent
Klenner et al.

(10) Patent No.: US 8,778,039 B2
(45) Date of Patent: Jul. 15, 2014

(54) COMPOSITE MATERIAL FOR FURTHER PROCESSING INTO SHEET-LIKE ABRASIVE PRODUCTS AND PROCESS FOR THE PRODUCTION THEREOF

(75) Inventors: Peter Klenner, Geisfeld (DE); Klaus Fuessmann, Bischberg (DE); Waldfried Weier, Strullendorf (DE)

(73) Assignee: Bamberger Kaliko Textile Finishing GmbH, Bamberg (DE)

( * ) Notice: Subject to any disclaimer, the term of this patent is extended or adjusted under 35 U.S.C. 154(b) by 0 days.

(21) Appl. No.: 13/811,138

(22) PCT Filed: Jul. 20, 2011

(86) PCT No.: PCT/EP2011/062418

§ 371 (c)(1),
(2), (4) Date: Jan. 18, 2013

(87) PCT Pub. No.: WO2012/022571

PCT Pub. Date: Feb. 23, 2012

(65) Prior Publication Data

US 2013/0111823 A1 May 9, 2013

(30) Foreign Application Priority Data

Jul. 21, 2010 (DE) ..... 10 2010 036 554

(51) Int. Cl.

| | |
|---|---|
| ***B24D 3/00*** | (2006.01) |
| ***B24D 11/00*** | (2006.01) |
| ***B24D 18/00*** | (2006.01) |
| ***C09K 3/14*** | (2006.01) |

(52) U.S. Cl.
USPC ..... 51/298; 51/293; 51/297

(58) Field of Classification Search
USPC ..... 51/298, 293, 297
See application file for complete search history.

(56) References Cited

U.S. PATENT DOCUMENTS

| | | | | |
|---|---|---|---|---|
| 4,035,961 | A * | 7/1977 | Pemrick et al. | 51/295 |
| 4,038,046 | A | 7/1977 | Supkis | |
| 4,140,829 | A | 2/1979 | Pemrick et al. | |
| 4,298,356 | A | 11/1981 | Teschner et al. | |
| 4,386,943 | A | 6/1983 | Gumbel et al. | |
| 5,681,612 | A | 10/1997 | Benedict et al. | |
| 5,830,248 | A * | 11/1998 | Christianson et al. | 51/295 |
| 5,858,140 | A * | 1/1999 | Berger et al. | 156/62.2 |
| 6,239,049 | B1 | 5/2001 | Follensbee et al. | |
| 6,465,076 | B2 * | 10/2002 | Larson et al. | 428/143 |
| 6,635,719 | B2 | 10/2003 | DeVoe et al. | |
| 7,008,312 | B2 | 3/2006 | Laubender et al. | |
| 2004/0043684 | A1 | 3/2004 | Dern et al. | |
| 2008/0127572 | A1 * | 6/2008 | Ludwig | 51/297 |
| 2010/0279061 | A1 | 11/2010 | Mayade | |
| 2011/0296767 | A1 * | 12/2011 | Lee et al. | 51/298 |

FOREIGN PATENT DOCUMENTS

| | | | |
|---|---|---|---|
| DE | 4227132 | A1 | 5/1993 |
| DE | 102007053498 | A1 | 5/2009 |
| GB | 1 362 993 | | 8/1974 |
| WO | WO 95/22438 | A1 | 8/1995 |
| WO | WO 2005/110681 | A1 | 11/2005 |

* cited by examiner

*Primary Examiner* — James McDonough
(74) *Attorney, Agent, or Firm* — Duane Morris LLP

(57) ABSTRACT

The invention relates to an elastically deformable composite material suitable to be processed further into sheet-like abrasive products, comprising a sheet-like supporting base coated or impregnated with a prepolymer material which obtains thermosetting properties when thermally post-cured, or consisting of a coated or impregnated supporting base, characterized in that the supporting base comprises at least one layer of bonded fibers selected among inorganic fibers and organic synthetic fibers, if necessary mixed with natural fibers. Moreover, it relates to a method for the manufacture of the composite material.

9 Claims, No Drawings

COMPOSITE MATERIAL FOR FURTHER PROCESSING INTO SHEET-LIKE ABRASIVE PRODUCTS AND PROCESS FOR THE PRODUCTION THEREOF

The present invention relates to a composite material, which is suitable as primary product ("abrasive medium") for the manufacture of sheet-like, usually relatively rigid, yet still elastically deformable abrasives such as abrasive disks etc.

In the past, sheet-like abrasive disks have been manufactured by first soaking a vulcanized fiber mat with an organic binding agent and subsequently drying it. Said product is sprinkled with abrasive particles by the manufacturer of abrasives, and an additional layer of the same or different binding agent is used to make said abrasive particles adhere on the substrate. The material obtained in this fashion is dried, fully cured and cut into the desired shape.

The manufacture of vulcanized fiber was disclosed long ago. Cotton and/or cellulose fibers are used as raw material. Said fibers are processed into paper webs, which subsequently pass through a parchmentizing bath whereby the surface of the individual fibers is etched; so-called hydrated cellulose forms at their surface. Said hydrated cellulose produces a deep conglutination of the fibers with each other.

These days, two different methods are being used in the practice, the first being the zinc chloride method. With it, the manufacture involves the soaking with almost saturated zinc chloride solution at a temperature of 75° C.; however, this can result in the accumulation of zinc in the material. The sulphuric acid method is equally significant from an industry point of view. With it, the paper mass is couched (i.e. the liquid is squeezed out), whereby the individual fibers as well as individual paper webs, if any, are bonded with each other. An almost homogeneous mass of fibers surrounded by hydrated cellulose is created without the addition of any other binding agents.

Large quantities of water are required for both methods. The used processing agents zinc chloride and sulphuric acid are extremely harmful to the environment.

The quality of the vulcanized fiber is determined by the fiber quality and the setting of the parchmentizing.

With the necessary experience, the possible variations can be used to manufacture vulcanized fibers with different qualities and hence to match their properties to specific areas of application.

A number of proposals exist with respect to which binding agent(s) the vulcanized fiber material can be coated with in order to obtain an abrasive medium. For example, in DE 28 53 761 it is proposed that at least the primary coat should consist of a specific quantitative proportion of a resol comprising a monovalent phenol and formaldehyde.

In DE 103 04 958 A1, the use of an aqueous polymer dispersion consisting of dispersed polymer particles of at least a first addition polymer having a specific glass transition temperature is proposed, which was manufactured by means of radical emulsion polymerization in the presence of a second addition polymer consisting of at least one ethylenic unsaturated mono- and/or dicarbonic acid as well as at least one specifically defined, ethylenic unsaturated ester. Said polymer dispersion can be used to coat papers, fabrics or other substances suitable for abrasion purposes. According to EP 1 141 125 B1, paper, fabric, foil or vulcanized fibers can be used as abrasive media; a combination of a specific oligomeric aminoplastic resin and a thermoplastic polyamide is proposed as composition of the coating.

The high water absorbency in excess of 8% which is in particular due to the high alkali content is a disadvantage of the use of vulcanized fibers as basic material for abrasive disks etc. The water absorption causes the disk to undulate. Moreover, the disks have a tendency to become brittle.

The manufacture of flexible abrasives with the use of a base fabric containing polyester with an amine-formaldehyde resin is described in DE AS 29 28 484. This illustrates the problems in terms of rigidity, flexibility and ductility the person skilled at the art has to contend with if he wishes to use a fabric as supporting base. In particular, it is emphasized that it is disadvantageous to coat these kinds of fabrics with binding agents made of phenolic resins based on Resorcinol or Resorcinol-formaldehyde. Another polyester fabric as substrate for abrasive cloths is disclosed in DE OS 25 31 642.

Synthetic resin-bonded molds which can be suitable among other things as abrasive disks are also disclosed in DE 102 30 573 A1. For their manufacture, a fabric insert is impregnated with a thermosetting binding agent to which a fatty acid amide is added to avoid conglutination and hence to achieve the flawless separation of the stacked fabric inserts.

A method for the manufacture of abrasive paper or abrasive cloths is disclosed in DE OS 26 59 029. Accordingly, the abrasive particles are applied and fixed by means of a suspension containing a primary condensate of urea and formaldehyde, a liquid phenolic resin and the abrasive particles. However, it has been determined that the application and fixation of the abrasive particles directly onto a (potentially bonded) fibrous web by way of said suspension does not result in a product with the required stability. The latter must be sufficient to withstand the centrifugal forces associated with the fast rotation of the abrasive disk.

Fabrics are generally used for so-called "flap disks" or flap disk applications (laminated "abrasive mop disks") rather than for large scale abrasive disks.

Elastic molds, such as they are commonly used for example in households under the name "Scotch Brite" represent an entirely different class of abrasive substances. Said type of mold is described for example in US 2008/0127572 A1.

Specific abrasive disks are required in the automotive industry. According to DE 10 2007 053 A1, the organic binding agents used for this purpose contain e.g. phenolic resins and are ultimately carbonized together with the other components.

Fabrics are used for the manufacture of continuous abrasive belts, see e.g. WO 2005/110681 A1 or EP 1 113 903 B1. Alternatively, a method in which a fibrous material is pressed against the outer wall of a drum, said fibrous material subsequently being solidified into a continuous belt with the addition of a precursor of a binding agent and rotation of the drum by means of centrifugal forces is proposed in U.S. Pat. No. 5,681,612.

However, the stress continuous abrasive belts are exposed to is completely different than for abrasive disks. As mentioned above, fabrics are generally not suitable for e.g. round abrasive disks. In fact, said abrasive disks are not at all used in the practice for this very reason. Their ductility would in fact be considerably greater diagonally to the direction of the thread than in the direction of the beam and weft thread. Yet, depending on the used fabric, said direction would also have different degrees of ductility if different beam and weft threads were used. The person skilled at the art should therefore expect that these types of base materials would result in the "wearing out" and undulating of the abrasive disk. Moreover, an extremely high thread density in the fabric would be required to achieve a sufficient internal stability which would be a cost-driving factor. This is likely the reason why vulcanized fiber materials are still predominantly being selected as base material for abrasive disks in the practice.

The object of the invention is to allow the manufacture of an abrasive material which is a suitable means for abrading smooth or shaped surfaces, in particular in the shape of (e.g. round) abrasive disks. Preferably, the latter can be manufactured as separable continuous material (retractable material) and comprise a lower water absorbency compared with vulcanized fiber-based products on the one hand and a high tear strength on the other hand, while complying with the DIN EN 13743 (burst speed) test standard.

The object is solved with the provision of an abrasive medium in the form of a composite material having a supporting base manufactured with bonded fibers and solidified with a prepolymer resin (in the form of a solution, a dispersion or a suspension), which can be post-cured into a thermosetting polymer when exposed to heat. The purpose of said abrasive medium is to transform it into an abrasive material at any point in time by means of sprinkling it with abrasive (e.g. abrasive particles) and by applying and curing an additional layer of binding agent.

The inventors were surprised to discover that an abrasive material manufactured in this fashion did not have the disadvantage of vulcanized fiber abrasive disks on the one hand, while it is considerably more stable than an abrasive material obtained with the direct application of an abrasive suspension onto a (possibly bonded) fibrous web. In particular, abrasive materials that can be manufactured on the basis of the abrasive medium of the present invention not only meet the requirements of the maximum burst speeds of round abrasive disks, but they in fact by far exceed them.

The cured polymer having thermosetting properties which was created from the prepolymer should have a relatively high glass transition temperature Tg, which exceeds 80° C., preferably even 100° C. The resin solution, dispersion or suspension should have shear stability and contain a solids component of approximately 30-65 mass percent, preferably approximately 45-55 mass percent; preferred solvents are an aqueous solvent or water. Good film forming properties are beneficial. The resin can be selected as desired, e.g. among the resins commonly used for abrasive disks; it is preferably selected from acrylates that are hardened to become thermosetting resins when exposed to heat, said acrylates being mixed with thermoplastic acrylates if necessary, and/or resins hardened to become phenolic polymers, among them in particular phenol formaldehyde resin produced by condensation.

As mentioned earlier, the supporting base has the shape of a laid scrim, meaning that it is a large scale textile structure in which the fibers are not bonded with each other by way of interconnected fabric or stitches or similar, but are arranged side-by-side and/or on top of each other—generally unbonded or bonded with each other later by means of chemical or physical procedures such as e.g. described below. Particularly preferred, this concerns a fibrous web which can be manufactured for example as a spun-bonded fabric, aerodynamically or hydrodynamically or as a carded fibrous web, or a laid scrim, in which layers of adjacent threads were arranged at a right angle or at a different angle to each other and subsequently connected with each other, for example by means of thermal bonding. If necessary, the fibrous web can be arranged in two or multiple layers; its fibers may or may not be reinforced by means of chemical procedures (in particular with the addition of binding agent) or by means of mechanical procedures, in particular needle punching, water jet treatment, stretching or stitch bonding technique or with the addition of fused fibers. In addition, it is possible to use a laminate consisting of at least one fibrous mesh and at least one laid scrim or a laminate consisting of a plurality of fibrous meshes or a plurality of laid scrims.

The fibers of the supporting base can be inorganic fibers or organic, generally synthetic fibers; in some cases, it is beneficial to mix them with natural fibers such as cellulose fibers. Cellulose fibers according to the invention relate to fibers obtained by means of a method for producing spun-bonded viscose (from the regenerating bath, e.g. cut retroactively). Among other things, said types of fibers differ from the cellulose pulp fibers used for vulcanized fibers in that they are considerably longer (usually approximately 20-60 mm compared to pulp fibers with an approximate length of 3 mm). For the present invention, it is preferable to use e.g. polyamide (PA), polyester (PES) or glass fibers, if necessary additionally mixed with cellulose fibers. Inorganic fibers can be surface-modified, e.g. silicone-treated or organically modified with alkyl silanes or similar substances. Natural fibers should generally be provided in chemically unaltered format and should in particular not contain an outer layer comprising hydrate cellulose. If polyester fibers are used, the material polyethylene terephthalate (PET) is preferred. Moreover, mixtures among said fibers, for example mixtures of PA and PES, PES and cellulose or PES and glass fibers are possible. If mixtures are used, they can be distributed homogeneously within the laid scrim or be provided separated by fiber type. One example for the latter are laminates having a first laid scrim consisting of a first material and a second laid scrim consisting of a second material. Relevant factors for the fiber selection first include a good connection of the prepolymer resin or the prepolymer suspension or dispersion on the one hand and the thermal stability of the finished base material coated with the thermosetting polymer on the other hand, because abrasion causes frictional heat which can locally briefly rise up to 800° C. depending on the area of application. Favorable results are achieved for example with a laminate consisting of a fibrous polyester mesh and a glass fiber laid scrim. The presence of the glass fibers improves the thermal stability of the composite material for future uses.

In one specific embodiment, the base material consists of polyester fibers or of a combination of polyester and inorganic fibers, among them in particular glass fibers, and is coated with an acrylate resin that hardens to become a thermosetting polymer. Said embodiment is particularly preferred because the acrylate resins that can be used for the invention adhere well to polyester, but also to glass surfaces.

The base material preferably has a thickness ranging from 0.2 to 1.5 mm and a weight between 50 and 800 g/m$^2$.

The base material is impregnated, e.g. soaked or coated with the resin. When soaked, it can be saturated with a relatively low-viscous resin solution. Another impregnation option consists in spraying the resin solution onto the base material. In the process, the fiber surfaces are enveloped with the resin. Higher-viscous formulations are generally used as coating, which are applied onto the surface of the base material where they form a cohesive layer. Both variants, the enveloping of the fibers with resin and the application of a coat onto the surface of the base material can be used alternatively, and cumulatively, if necessary. It is beneficial to impregnate, e.g. to saturate the base material with the resin of an aqueous dispersion/suspension and to quetch the excess afterward. This can be done on a tentering frame or continuously on the unwinding material.

Normally, resin is applied at a quantity at which the prepolymer is absorbed into the base material at a quantity of usually about 50-800 g/m$^2$ after the drying/evaporation of the solvent depending on the weight of the supporting base, required material strength and required final weight.

Next, the base material with the applied resin is dried at a temperature/a temperature profile and/or during a period which are below the curing temperatures and/or the curing periods for the final cross-linking of the respective material. Temperatures ranging between 80 and 160° C. can be beneficial for this purpose. The drying period is generally less than one hour. For example, the transit time through a drying cabinet with a transit length of e.g. 30 m can preferably be 0.5-10 min., more preferably 1 to 8 min. In order to obtain a surface as smooth as possible and a density as high as possible, the material can then be calendared. The calendaring pressure is preferably around 50-300 N/mm (line pressure), while the calendaring temperature normally ranges between the ambient temperature (approx. 20-25° C.) and 150° C.

Depending on the thickness of the base material, a sheet-like composite material with a grammage of preferably about 100-1600 g/m$^2$ and a thickness generally ranging between 0.15 and 2.5 mm, preferably about 0.2 to 1.5 mm is obtained.

Next, the product can be sprinkled with abrasive particles and fully cured after the particles have been coated with a coat of resisting binding agent. Said curing normally requires a period of three to four days at a temperature ranging between 115 and 140° C. If necessary, the abrasive particles can be sprinkled on after the application of a binding agent base coat. This can be done as needed, either applied directly onto any kind of pre-cut shapes, for example round disks, or the parts can be separated once the material has been completed.

Traditionally, abrasives are applied onto the composite material according to the invention by the manufacturer of the abrasives; obviously, it is possible to combine both manufacturing steps in a single work sequence instead.

The invention is explained in more detail below by means of several examples and a comparative example.

EXAMPLE 1

A fibrous mesh consisting of mechanically bonded 100% PES (eswegee Vliesstoff GmbH) with a grammage of approx. 400-450 g/m$^2$ and a thickness of 3 mm was soaked with an aqueous phenol formaldehyde dispersion (Phenodur VPR 1740 by Cytec) with a solids content of 50 mass percent on a Monforts tentering frame. Excess material was quetched; after that, the fibrous mesh had absorbed approx. 800 g/m$^2$ of the dispersion. Next, it was guided across a 30 m drying frame with a speed of 10 sec/m, where it was exposed to a temperature profile of 120° C.-180° C. The fibrous mesh treated in this fashion had a thickness of about 1.4-1.7 mm. The thickness was reduced to about 0.65-0.75 mm with the subsequent calendaring. The product did not yet have any thermosetting properties; it had a grammage of approx. 800-850 g/m$^2$.

EXAMPLE 2

Example 1 was repeated with the change that an aqueous dispersion of a formaldehyde-free Acrodur acrylate (of a thermosetting polymer) from the Company BASF was used instead of the phenol formaldehyde dispersion.

GROUP OF EXAMPLES 3

Example 2 was repeated with the change that instead of the formaldehyde-free Acrodur acrylate from the Company BASF mixtures of said acrylate were used with (thermoplastically hardening) acrylates of different hardness types (with glass transition temperatures between 30° C. and 60° C.) as well as a bonding component (a melamine or urea resin).

COMPARATIVE EXAMPLE

A vulcanized fiber material having a thickness of approx. 0.7 mm and a grammage of approx. 800 g/m$^2$ was treated as described in example 1. The product had a grammage of 815 g with a thickness of only 0.66 mm.

The materials of all examples were coated in the same fashion as described in the prior art with an aqueous phenolic resol as binding agent base coat, sprinkled with abrasive particles, e.g. corundum and dried. Next, the particles were coated with a binding agent cover coat to stabilize them, said binding agent cover coat consisting of an aqueous phenolic resol with pulverized calcium carbonate as filler and a rheological additive (a flow-control additive to reduce the surface tension). The material coated with abrasive particles was dried and fully cured at 90-150° C. which required several days. The coat of the product had thermosetting properties.

The properties of the materials according to example 1 and the comparative example are illustrated in Table I below. An extreme reduction in water absorption (from more than 8% to less than 1%), comparable tear strengths in the longitudinal and diagonal direction and greatly improved tear propagation strength in these two directions are observed. The longitudinal/diagonal strength ratio is greater than about 75%, while it is considerably lower for a vulcanized fiber board.

TABLE I

| | Unit | Invention | Comparative example |
|---|---|---|---|
| Thickness | mm | 0.7 | 0.66 |
| Grammage at hand | g/m$^2$ | 799 | 815 |
| Grammage absolutely dry | g/m$^2$ | 798 | |
| Grammage after 24 h of air-conditioning | g/m$^2$ | 802 | |
| Increase in moisture | g/m$^2$ | 4 | |
| Increase in moisture | % | 0.5 | 8.1 |
| Diagonal/longitudinal tear strength ratio | Factor | 0.83 | 0.68 |
| Longitudinal tear strength, cured, 2 h 130° C. | N/50 mm | 2052 | |
| Longitudinal elongation at tear, cured, 2 h 130° C. | % | 26.0 | |
| Diagonal tear strength, cured, 2 h 130° C. | N/50 mm | 1624 | |
| Diagonal elongation at tear, cured, 2 h 130° C. | % | 23.1 | |
| Diagonal/longitudinal ratio | Factor | 0.79 | |
| Longitudinal tear propagation strength | N/50 mm | 32.3 | 12.7 |
| Diagonal tear propagation strength | N/50 mm | 39.1 | 14.0 |
| Longitudinal tear propagation strength after hydration | N/50 mm | ca. 45 | 5 |
| Diagonal tear propagation strength after hydration | N/50 mm | Ca. 49 | 4.5 |

After the maximum possible moisture uptake, the material of example 1 continued to rest completely level on a flat base, while the one of the comparative example was wavy. This not only promises the better handling of abrasive disks made of the material according to the invention, but provides the buyer with a product whose appearance signals good functionality.

To measure the tear propagation strength after hydration, the samples were each stored in water for a prolonged period of time and then only drip-dried and carefully dabbed to remove water adhering to the surface.

EXAMPLE 4

A material on the basis of example 2 was provided with abrasive particles as described above, in that it was first coated with a binding agent base coat, consisting of an aqueous phenolic resol, calcium carbonate and a rheological additive, then sprinkled with abrasive particles and dried. Next, the particles were coated with a binding agent cover coat to stabilize them, said binding agent cover coat also consisting of an aqueous phenolic resol having pulverized calcium carbonate as filler and a rheological additive. The material coated with abrasive particles was dried and fully cured at 90-150° C., which required several days. The coat of the product had thermosetting properties.

The abrasive material obtained in this fashion was subject to a burst speed test according to DIN EN 13743 to determine up to which rotating speed the material can be handled safely without the risk of the disk bursting. The burst speed is the value in rpm at which an abrasive disk with a defined diameter bursts because of the centrifugal force. Defined standard values depending on the diameter of the disks are available for this purpose.

As illustrated in table II below, it was determined that an abrasive material can be obtained whose burst speeds are far higher than the target burst speeds with the provision of the abrasive particle-free interior structure according to the invention, consisting of a sheet-like supporting base having at least one layer of bonded fibers which is coated or impregnated with a prepolymer material, said material acquiring thermosetting properties when post-cured:

TABLE II

| Disk diameter mm | Routine rotational speed rpm | Target burst speed rpm | Burst speed in example 4, rpm |
|---|---|---|---|
| 115 | 13293 | 24868 | 26210 |
| 125 | 12229 | 22879 | 23112 |
| 180 | 8493 | 15888 | 18132 |

The routine rotational speed is calculated based on a rotational speed of 80 m/s. The target rotational speed contains a safety buffer included in the calculation.

Finished abrasive disks on the basis of the invention were used for abrading narrow radii, e.g. gutters in automobiles, iron, stainless steel and neon weld seams. The abrasive disks were characterized by superior rigidity, which can be deformed for abrading narrow radii but do not burst when reset.

The abrasion of (stainless steel) weld seams was compared with the abrasion using abrasive disks on the basis of vulcanized fiber according to the comparative example. The result of the application demonstrated advantages for the present invention in terms of service life and abrasive removal. Both results are due to the better adhesion of the abrasion particles compared to vulcanized fibers. The adhesion of the abrasion particles on the material in example 1 is considerably better than the one on the vulcanized fiber board due to its rougher and more fibrous surface and hence the improved mechanical anchorage.

An additional advantage of the composite material according to the invention was identified when smaller tears occurred at the abrasion disk in connection with intensive use. While these tears instantly become larger in the comparative material, the abrasive disks made of the composite material according to the invention demonstrated a considerably greater tear propagation strength in longitudinal and diagonal direction.

No embrittlement tendency such as it is observed in vulcanized fiber materials due to the present cellulose and the extremely short fiber lengths is expected for the materials according to the invention.

The invention claimed is:

1. An elastically deformable composite material suitable to be processed further into sheet-like abrasive products, consisting of a sheet-like supporting base made of a fibrous construction or a laminate comprising at least one fibrous web and at least one laid scrim or is laminate comprising a plurality of fibrous webs or a plurality of laid scrims, wherein the elastically deformable composite material has a grammage of 100 to 1600 g/m$^2$ and a thickness between 0.15 and 2.5 mm, characterized in that the supporting base comprises at least one layer of laid fibers selected from inorganic fibers and organic synthetic fibers, if necessary mixed with natural fibers and that the supporting base is coated or impregnated with a prepolymer material, said prepolymer material acquiring thermosetting properties when thermally post-cured, wherein the prepolymer material was applied onto the supporting base in the form of a resin, a dispersion or a suspension and then dried, but not thermally post-cured such that it is present in a solidified status, but not in its fully cured status where it is a thermoset.

2. An elastically deformable composite material according to claim 1, characterized in that the supporting base exclusively comprises laid fibers.

3. An elastically deformable composite material according to claim 1, characterized in that the fibers have the shape of a single-layer or multi-layer fibrous web, or a single-layer or multi-layer laid scrim, or a combination of at least one fibrous web and one laid scrim.

4. An elastically deformable composite material according to claim 1, characterized in that the material of which the fibers are made is selected from polyesters, polyamides, glass fibers which can be surface-modified, mixtures comprising a plurality of said fibrous materials or mixtures comprising one or a plurality of said fibrous materials and cellulose.

5. An elastically deformable composite material according to claim 3, characterized in that the supporting base is a laminate consisting of at least two identical or different layers.

6. An elastically deformable composite material according to claim 5, characterized in that one of the layers is a fibrous web and a second layer is a laid scrim.

7. An elastically deformable composite material according to claim 5, characterized in that one of the layers comprises polyester fibers and a second of the layers comprises glass fibers.

8. An elastically deformable composite material according to claim 1, characterized in that the prepolymer material was applied from the aqueous phase.

9. An elastically deformable composite material according to claim 1, characterized in that the prepolymer material is an acrylic material which becomes a thermosetting polymer when fully cured, said acrylic material being mixed with a thermoplastic acrylic material if necessary, and/or that the prepolymer material is a resin which becomes a phenolic polymer when fully cured, in particular a phenol formaldehyde resin produced by condensation.

* * * * *